US011571055B2

(12) United States Patent
Tu

(10) Patent No.: US 11,571,055 B2
(45) Date of Patent: Feb. 7, 2023

(54) HAIR CLAW CLIP

(71) Applicant: TSORNG TA ENTERPRISE CO., LTD., Tainan (TW)

(72) Inventor: Jui-Ming Tu, Tainan (TW)

(73) Assignee: TSORNG TA ENIERPRISE CO., LTD., Tainan (TW)

( * ) Notice: Subject to any disclaimer, the term of this patent is extended or adjusted under 35 U.S.C. 154(b) by 944 days.

(21) Appl. No.: 16/355,597

(22) Filed: Mar. 15, 2019

(65) Prior Publication Data

US 2020/0288837 A1 Sep. 17, 2020

(51) Int. Cl.
*A45D 8/22* (2006.01)

(52) U.S. Cl.
CPC ..... *A45D 8/22* (2013.01)

(58) Field of Classification Search
CPC ... A45D 8/22; A45D 8/20; A45D 8/24; A45D 8/26; A45D 8/28; A45D 8/30; A45D 8/14
USPC ..... 132/277, 273; D28/40
See application file for complete search history.

(56) References Cited

U.S. PATENT DOCUMENTS 6,408,859 B1 * 6/2002 Shyu ..... A45D 8/20 132/276
7,984,720 B2 7/2011 Tu
8,056,570 B2 * 11/2011 Tu ..... A45D 8/16 132/275
2004/0182411 A1 * 9/2004 Rogers ..... A45D 8/22 132/277
2008/0257375 A1 * 10/2008 Tu ..... A45D 8/16 132/277
2009/0090379 A1 * 4/2009 Potut ..... A45D 8/22 132/277

FOREIGN PATENT DOCUMENTS

DE 202019101691 U1 * 4/2019 ..... A45D 8/20

* cited by examiner

*Primary Examiner* — Tatiana L Nobrega
(74) *Attorney, Agent, or Firm* — J.C. Patents

(57) ABSTRACT

This invention relates to an innovative hair claw clip, which includes at least a first body, a second bod, an automatic opening device and at least four sets of snap-fit structures as main components combined together. Said snap-fit structures are respectively arranged on the adjacent positions of the corresponding first rib of said first body and the second rib of said second body, said snap-fit structures can improve the service life and stability of the hair claw clip during the clamping operation and the opening operation. Moreover, through the new anti-slip structure design, the present invention can be held more firmly by the user, and the hair claw clip sandwiched on the hair will not be easily slipped from the hair even if the hair is not clamped tightly.

8 Claims, 9 Drawing Sheets

HAIR CLAW CLIP

BACKGROUND OF THE INVENTION

1. Field of the Invention

This invention relates to a hair claw clip, particularly to a hair claw clip that allows the user to control the tightness of the hair claw clip and has an automatic opening function.

2. Description of the Prior Art

Traditional hair claw clip, such as the U.S. Pat. No. 7,984,720 (B2) "BOBBY PIN" invented by the inventor, the foregoing bobby pin includes a left body and a right body respectively having plural ribs that are formed with plural teeth for engaging with each other to keep hair firmly clamped. The left and the right body have an opening device that is provided with a root member respectively, with a pivotal pin mounted with a compression spring and a torsion spring. In using, press inward the two bodies to keep the teeth engaged with each other for clamping hair. And, as long as the opening device is pressed, the two bodies can be immediately separated from each other for releasing hair.

According to a long-term study by the inventor, although the foregoing bobby pin can provide a strong clamping force when the plural teeth arranged on the both sides of the corresponding ribs. However, during the manufacturing process, the shape of the plural teeth will inevitably have slight errors; or when the user uses the bobby pin for a period of time, the bobby pin will be slightly deformed or worn due to various external force factors or material deterioration, this will cause the problem that the plural teeth of two corresponding ribs are not tightly fitted. In this case, the bobby pin will be very difficult to tightly clamp during the clamping operation, the hair inside the bobby pin will be easily burst out of the bobby pin, and the bobby pin will be very easy to get stuck during the opening operation.

Moreover, the friction between the foregoing bobby pin and the hair is insufficient, and the user must tighten the bobby pin to prevent the bobby pin from slipping off the hair. However, too much force in the hair will hurt the hair and hinder the opening of the bobby pin. In addition, the outer surface of the foregoing bobby pin is too smooth, so it is not easy for the user to hold the bobby pin steadily, and it is very inconvenient to use.

Therefore, the inventor of this invention, having much experience in designing and manufacturing various hair clip and its related products, understands and researches the problem of the foregoing bobby pin and hence devised this invention.

SUMMARY OF THE INVENTION

The objective of this invention is to offer an innovative hair claw clip, which is provided with a new snap-fit structure on the first body and the second body of the hair claw clip to improve the service life and stability of the hair claw clip during the clamping operation and the opening operation. Moreover, through the new anti-slip structure design, the present invention can be held more firmly by the user, and the hair claw clip on the hair will not be easily slipped from the hair even if the hair is not be clamped tightly by the hair claw clip.

The hair claw clip in the present invention includes at least a first body, a second bod, an automatic opening device and at least four sets of snap-fit structures as main components combined together. Said first body is provided with a plurality of first ribs at one end and a plurality of first rotating shaft brackets at the other end, said second body is provided with a plurality of second ribs at one end and a plurality of second rotating shaft brackets at the other end. Said automatic opening device is arranged between said first rotating shaft brackets of the first body and said second rotating shaft brackets of the second body, said automatic opening device is provided with a pivot, at least one first elastic member is mounted between the adjacent first rotating shaft bracket and the second rotating shaft bracket, said pivot is provided with a second elastic member, the two sides of the second elastic member respectively against the inner side of said first body and the inner side of said second body. Said snap-fit structures are respectively arranged on the adjacent positions of the corresponding first rib and the second rib; said snap-fit structures is provided with a one-way tooth row and a locking protrusion which are respectively arranged on the adjacent positions of the corresponding first rib and the second rib.

The hair claw clip of the present invention, among which when the one-way tooth row and the locking protrusion of said adjacent snap-fit structures are arranged in opposite directions, the clamping force of the hair claw clip is the most average, and can effectively prevent the hair claw clip from being opened by the pressure of the hair.

The hair claw clip of the present invention, among which said first body and second body may be provided with a hollow portion, so that the material cost of the hair claw clip can be saved, the adhesion between the hair claw clip and the hair can be improved, the hair claw clip can becomes better for the user to hold, and the visual beauty of the hair claw clip can be increased. Said first body and second body may be provided with an anti-slip member on its outer surface to increase the anti-slip effect of the hair claw clip.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
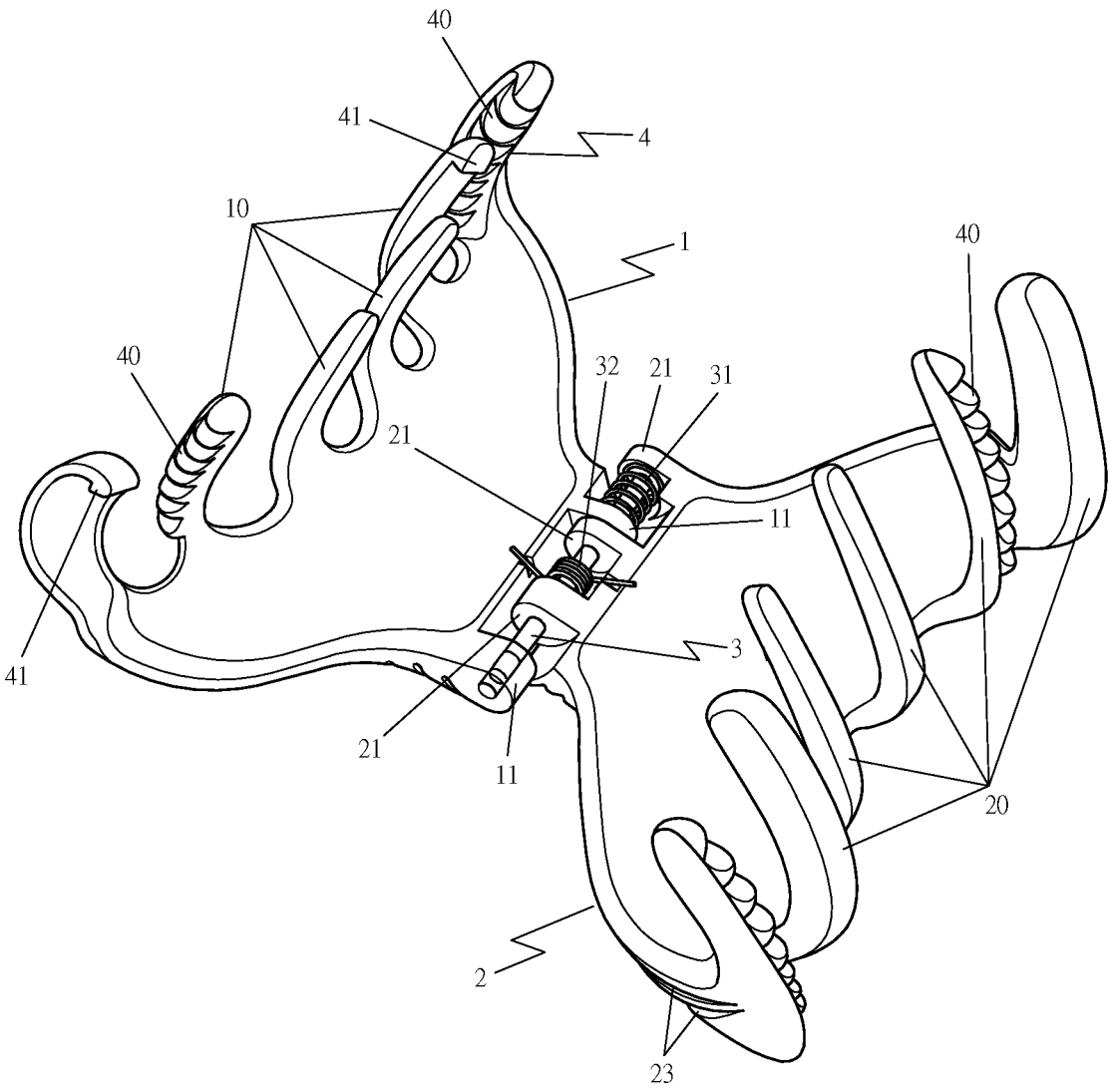
FIG. 1 is a perspective view showing an open state of the first embodiment of the hair claw clip in the present invention.
Figure 2:
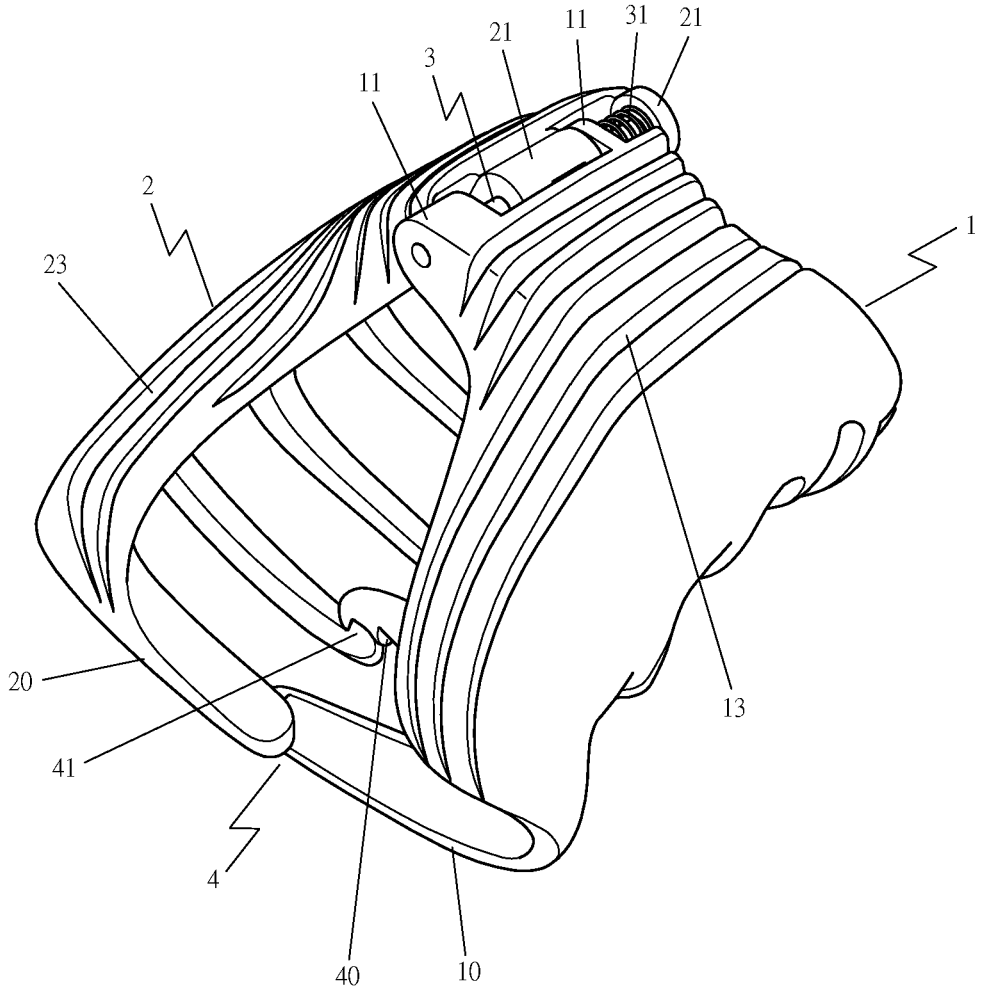
FIG. 2 is a perspective view showing a closed state of the first embodiment of the hair claw clip in the present invention.
Figure 3:
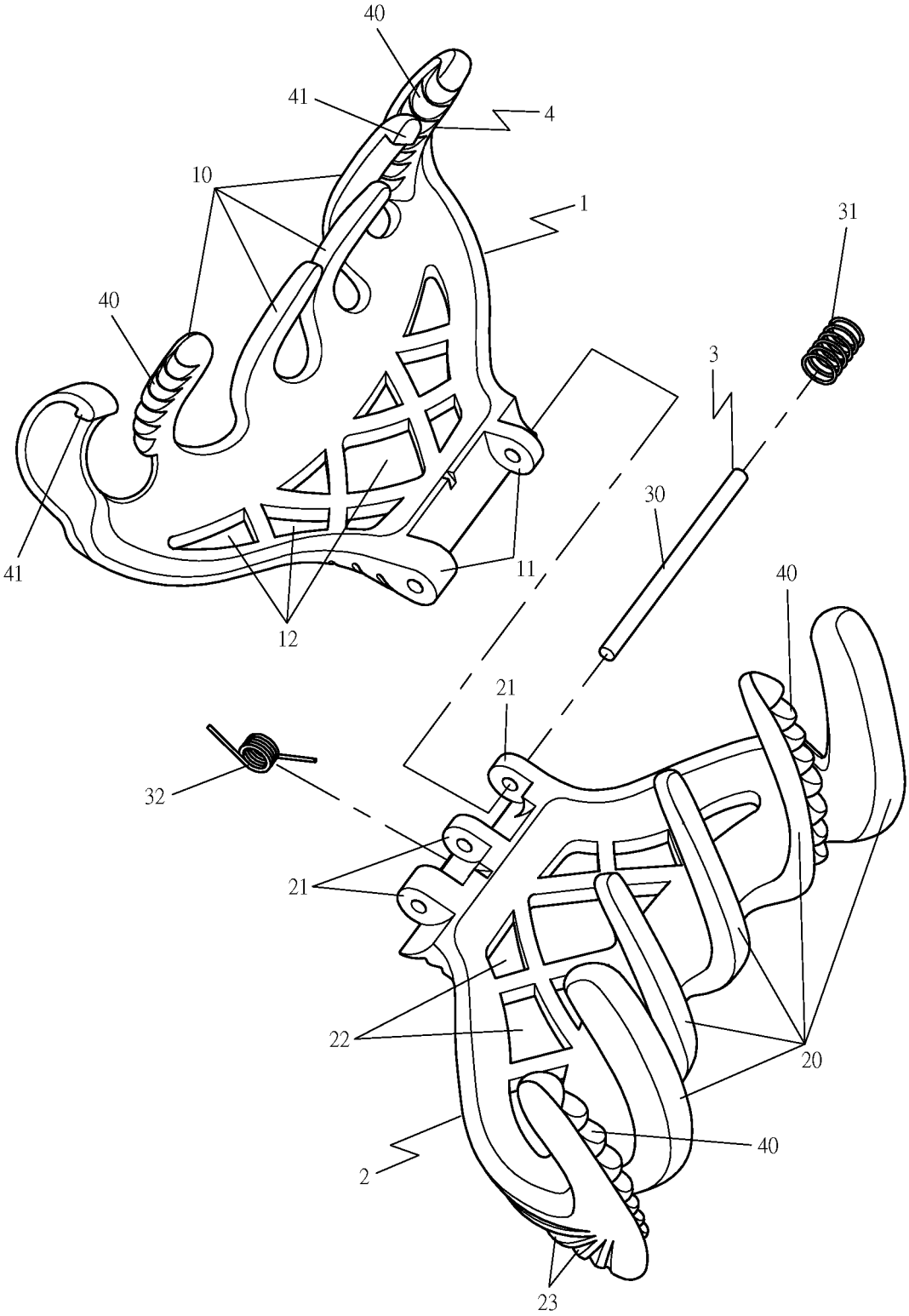
FIG. 3 is an exploded view of the second embodiment in the present invention.
Figure 4:
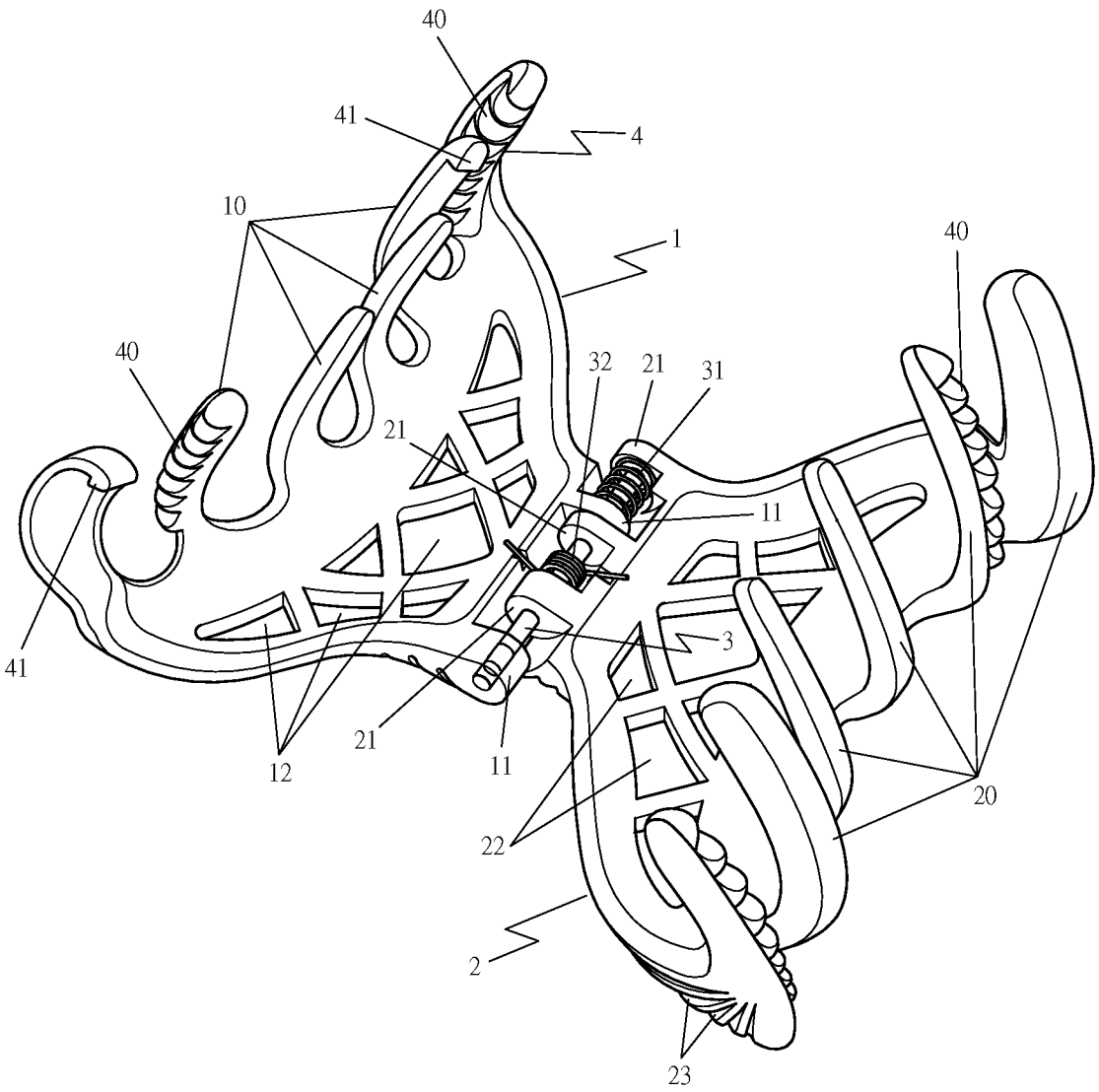
FIG. 4 is a perspective view of the second embodiment in the present invention.

A preferred embodiment of the hair claw clip in the present invention, as shown in FIGS. 1 to 10 includes at least a first body 1, a second bod 2, an automatic opening device 3 and at least four sets of snap-fit structures 4 as main components combined together.

Said first body 1 is provided with a plurality of first ribs 10 at one end and a plurality of first rotating shaft brackets 11 at the other end. Each space formed between the adjacent first ribs 10 is greater than the width of each second rib 20 of the second body 2, and each space formed between the adjacent first rotating shaft brackets 11 is larger than the width of each second rotating shaft bracket 21 of the second body 2. In this way, the spaces formed by the adjacent first ribs 10 and the adjacent first rotating shaft brackets 11 can be used as the moving spaces of the second ribs 20 and the second rotating shaft brackets 21 of the second body 2, respectively; and the first body 1 and the second body 2 can be moved in the opposite direction.

As shown in FIGS. 3 to 10, said first body 1 may be provided with a first hollow portion 12, the first hollow portion 12 may be formed by a large hole or a plurality of small holes. In this way, the material cost of the first body 1 can be saved, the adhesion between the hair claw clip and the hair can be improved (Using the first hollow portion 12 to accommodate the squeezed hair to prevent the hair claw clip from slipping off the hair), the hair claw clip can be better held by the user, and the visual beauty of the hair claw clip can be increased. Said first body 1 may be provided with a first anti-slip member 13 on the outer surface of the first body 1 to increase the anti-slip effect of the hair claw clip. Said first anti-slip member 13 may be a plurality of lateral grooves (as shown in FIGS. 7 to 10), a plurality of protruding pieces, an anti-slip sheet or various anti-slip structures.

Said second body 2 is provided with a plurality of second ribs 20 at one end and a plurality of second rotating shaft brackets 21 at the other end. Each space formed between the adjacent second ribs 20 is greater than the width of each first rib 10 of the first body 1, and each space formed between the adjacent second rotating shaft brackets 21 is larger than the width of each first rotating shaft bracket 11 of the first body 1. In this way, the spaces formed by the adjacent second ribs 20 and the adjacent second rotating shaft brackets 21 can be used as the moving spaces of the first ribs 10 and the first rotating shaft brackets 11 of the first body 1, respectively; and the first body 1 and the second body 2 can be moved in the opposite direction.

As shown in FIGS. 3 to 10, said second body 2 may be provided with a second hollow portion 22, the second hollow portion 22 may be formed by a large hole or a plurality of small holes. In this way, the material cost of the second body 2 can be saved, the adhesion between the hair claw clip and the hair can be improved (Using the second hollow portion 22 to accommodate the squeezed hair to prevent the hair claw clip from slipping off the hair), the hair claw clip can be better held by the user, and the visual beauty of the hair claw clip can be increased. Said second body 2 may be provided with a second anti-slip member 23 on the outer surface of the second body 2 to increase the anti-slip effect of the hair claw clip. Said second anti-slip member 23 may be a plurality of lateral grooves (as shown in FIGS. 7 to 10), a plurality of protruding pieces, an anti-slip sheet or various anti-slip structures.

Said automatic opening device 3 is arranged between said first rotating shaft brackets 11 of the first body 1 and said second rotating shaft brackets 21 of the second body 2. Said automatic opening device 3 is provided with a pivot 30, the first rotating shaft brackets 11 of the first body 1 and the second rotating shaft brackets 21 of the second body 2 are staggered with each other, and the first rotating shaft brackets 11 and the second rotating shaft brackets 21 are pivotally connected by said pivot 30. In this way, when the first body 1 and the second body 2 are in the clamping action, said first ribs 10 and second ribs 20 are interlaced with each other, and the spaces respectively formed by the adjacent first ribs 10, second ribs 20, first rotating shaft brackets 11 and the second rotating shaft brackets 21 allow the first body 1 and the second body 2 to move laterally opposite to each other on the pivot 30.

At least one first elastic member 31 (such as a spring) is mounted between the adjacent first rotating shaft bracket 11 and the second rotating shaft bracket 21, so that an elastic support force can be generated between the adjacent first rotating shaft bracket 11 and the second rotating shaft bracket 21 to maintain the relative position of the first body 1 and the second body 2. Said pivot 30 is provided with a second elastic member 32 (such as a torsion spring), the two sides of the second elastic member 32 respectively against the inner side of said first body 1 and the inner side of said second body 2. In this way, the elastic force generated from the second elastic member 32 can be used to automatic spread out the hair claw clip and keep the hair claw clip in the opening state.

Said snap-fit structures 4 are respectively arranged on the adjacent positions of the corresponding first rib 10 and the second rib 20. Said snap-fit structures 4 is provided with a one-way tooth row 40 and a locking protrusion 41 which are respectively arranged on the adjacent positions of the corresponding first rib 10 and the second rib 20. In this way, when the first body 1 and the second body 2 are in the clamping action, each of the corresponding one-way tooth rows 40 and the locking protrusion 41 will lock to each other to maintain the clamping force of the hair claw clip. By inventor actual test, when the one-way tooth row 40 and the locking protrusion 41 of the adjacent snap-fit structures 4 are arranged in opposite directions (as shown in FIGS. 1 to 10), the clamping force of the hair claw clip is the most average, and can effectively prevent the hair claw clip from being opened by the pressure of the hair.

Figure 5:
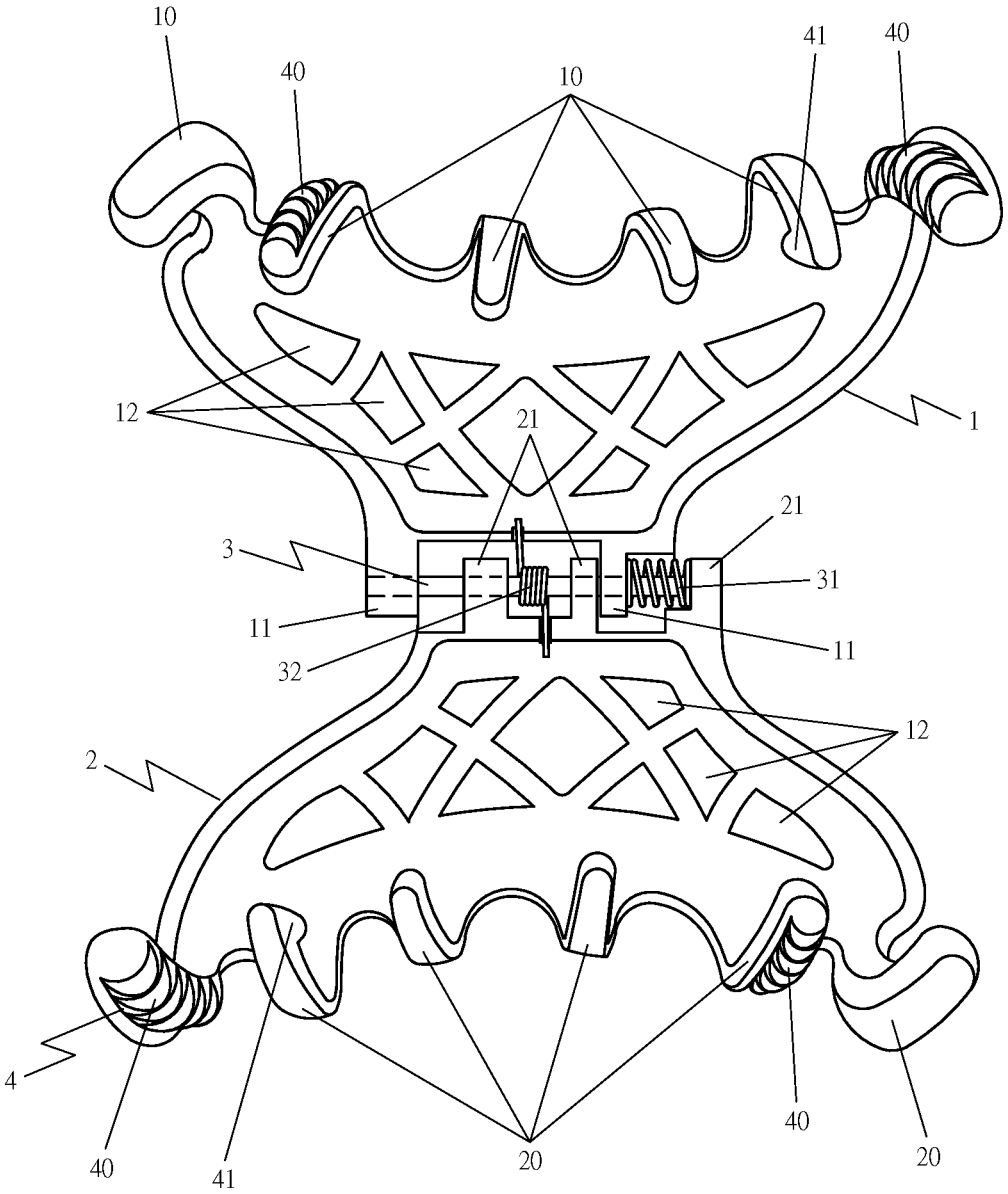
FIG. 5 is a top view showing an open state of the second embodiment of the hair claw clip in the present invention.
Figure 6:
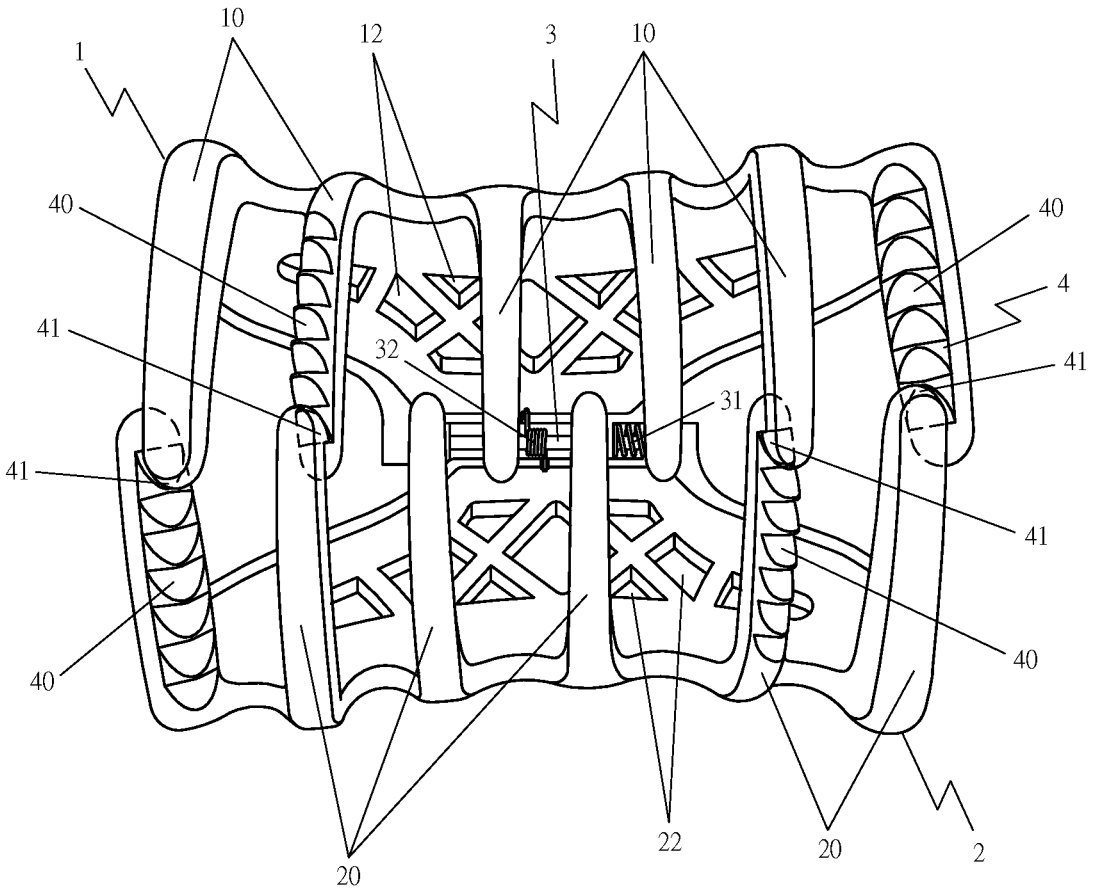
FIG. 6 is a top view showing a closed state of the second embodiment of the hair claw clip in the present invention.
Figure 7:
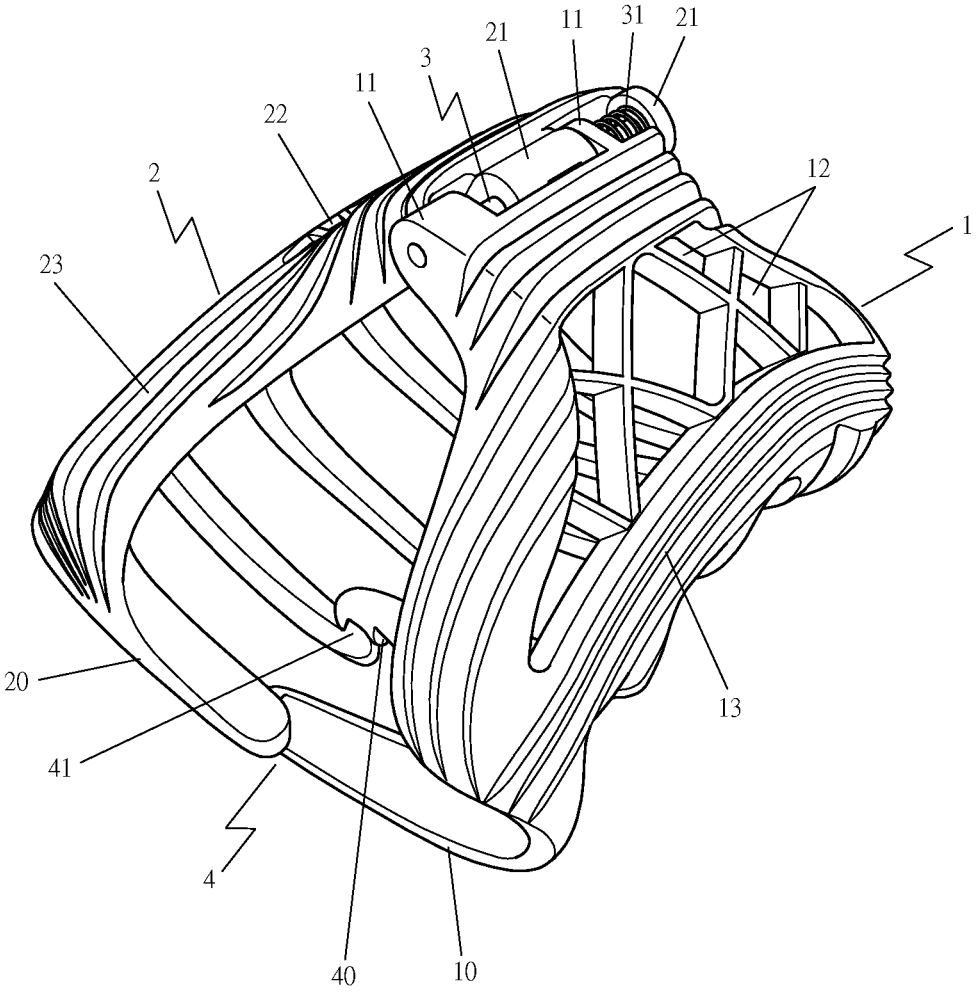
FIG. 7 is a perspective view showing a closed state of the second embodiment of the hair claw clip in the present invention.
Figure 8:
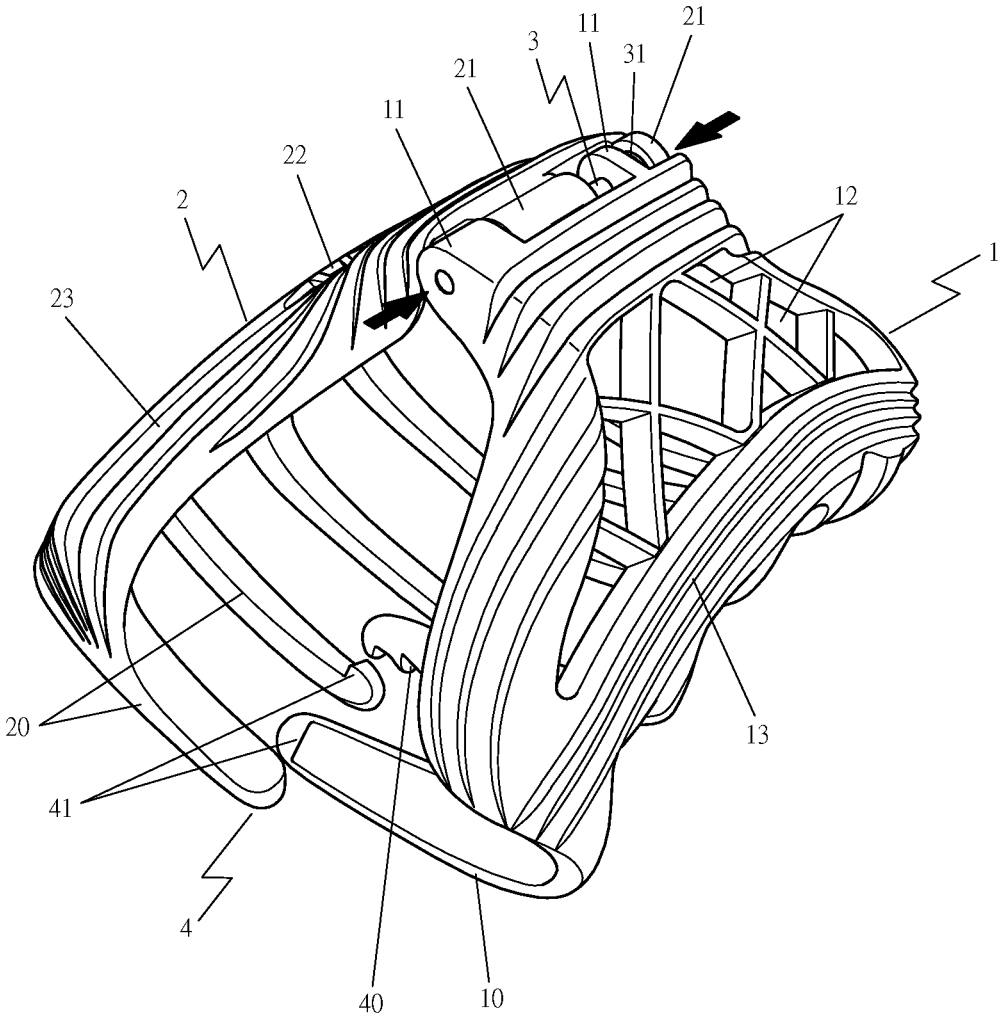
FIG. 8 is a schematic diagram showing the opening action of the second embodiment of the hair claw clip in the present invention.
Figure 9:
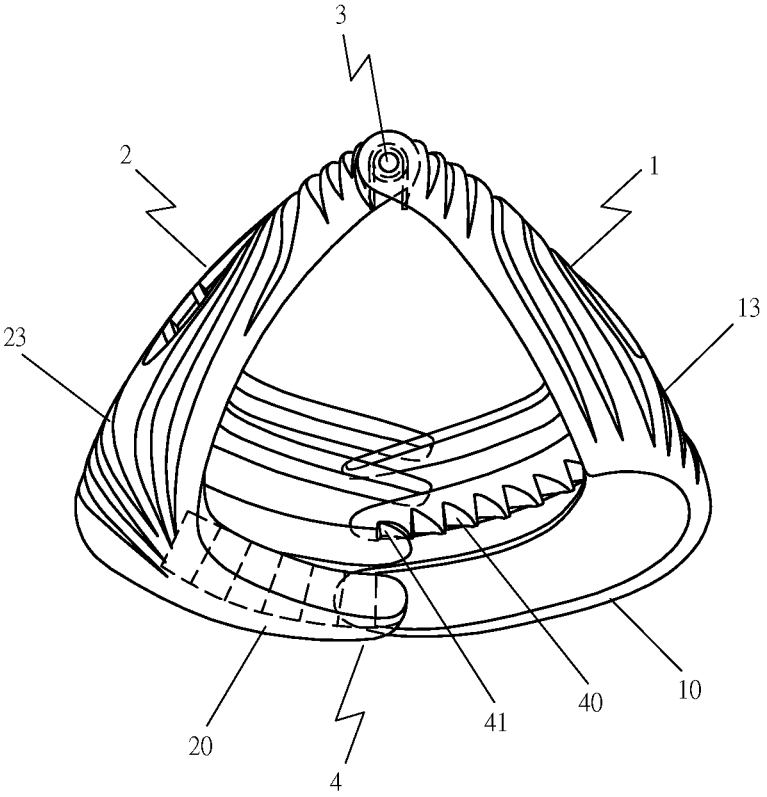
FIG. 9 is a side view showing a closed state of the second embodiment of the hair claw clip in the present invention.
Figure 10:
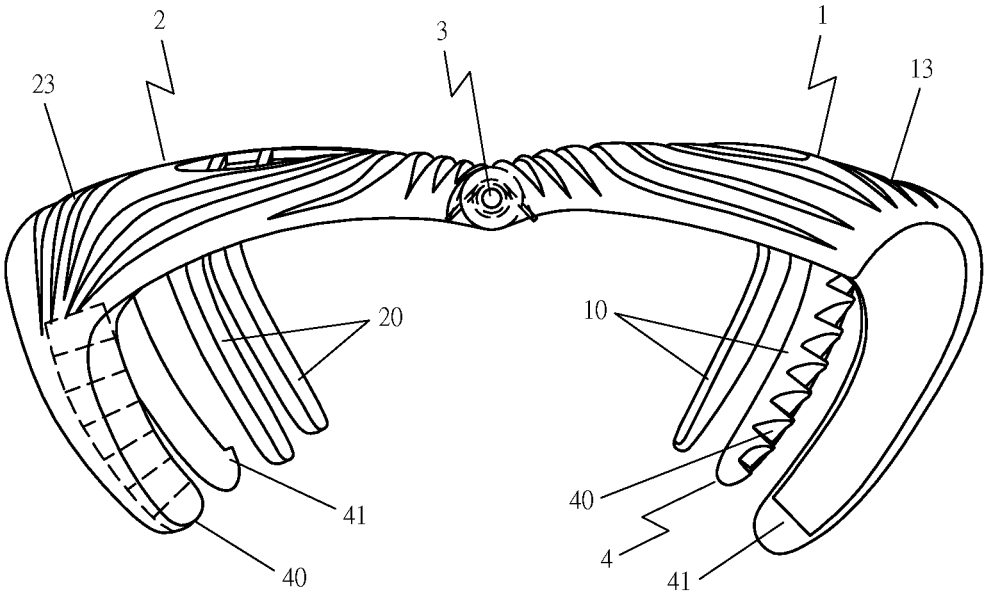
FIG. 10 is a side view showing an open state of the second embodiment of the hair claw clip in the present invention.

As shown in FIGS. 5 and 6, when the user uses the hair claw clip of the present invention, she only needs to hold the hair claw clip, then put her hair inside the hair claw clip and press the hair claw clip hard, the one-way tooth row 40 and the locking protrusion 41 of each the snap-fit structures 4 are mutually buckled and positioned, so that the hair claw clip can firmly held the hair. As shown in FIGS. 7 to 10, when the user presses the first rotating shaft bracket 11 and the second rotating shaft bracket 21 at both ends of the hair claw clip, the first elastic member 31 of the automatic opening device 3 is compressed, the first body 1 and the second body 2 generate reverse lateral movement, the one-way tooth row 40 and the locking protrusion 41 of each snap-fit structures 4 are separated from each other (as shown in FIG. 8); at this time, the second elastic member 32 of the automatic opening device 3 will automatically open the first body 1 and the second body 2 of the hair claw clip, so that the hair claw clip is restored to the open state. Therefore, the present invention can reliably solve the problem that the prior hair claw clip with short service life, easy to slip off the hair, not easy to be held by user, etc. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

What is claimed is:

1. A hair claw clip comprising:

a first body having a plurality of spaced apart first ribs at one end and a plurality of spaced apart first rotating shaft brackets at the other end;

a second body having a plurality of spaced apart second ribs at one end and a plurality of spaced apart second rotating shaft brackets at the other end, wherein each space formed between adjacent first ribs is greater than a width of each second rib, each space formed between adjacent first rotating shaft brackets is larger than a width of each second rotating shaft bracket, each space formed between adjacent second ribs is greater than a width of each first rib, and each space formed between adjacent second rotating shaft brackets is larger than a width of each first rotating shaft bracket;

wherein the first rotating shaft brackets of the first body and the second rotating shaft brackets of the second body are aligned and interlaced such that one of the first shaft brackets defines a first end and one of the second shaft brackets defines an opposing second end, and the remaining of the first and second rotating shaft brackets are disposed between the one of the first rotating shaft brackets and the one of the second rotating shaft brackets, the first and second rotating shaft brackets are connected by a pivot pin extending therethrough, a first elastic member is mounted on the pivot pin between the one of the second rotating shaft brackets defining the first end and the remaining first rotating shaft brackets, so that an elastic support force is generated therebetween to maintain a relative position of the first body and the second body, and a second elastic member is mounted on the pivot pin, where a first side of the second elastic member abuts against an inner side of the first body and a second side of the second elastic member abuts against an inner side of the second body, where the arrangement of the pivot pin and the first and second elastic members forms an automatic opening device;

at least four ribs selected from the plurality of first and second ribs, the at least four ribs each providing a one-way row of teeth, and at least four corresponding ribs of the plurality of first and second ribs having a locking protrusion, whereby the one-way row of teeth of the at least four ribs each engages a respective one of the locking protrusions of the at least four corresponding ribs via a snap-fit to lock the first and second bodies together in a closed clamping state when the first and second ribs are interlaced;

where during use, a user presses the one of the first rotating shaft brackets and the one of the second rotating shaft brackets defining the first and second ends, respectively, causing the first elastic member to compress, the first and second bodies to move laterally, the one-way row of teeth and the locking protrusion of each snap-fit structure to separate from each other and the second elastic member to automatically separate the first and second bodies restoring the hair claw clip to an open state.

2. The hair claw clip according to claim 1, wherein the one-way row of teeth and the locking protrusion of the adjacent snap-fit structures are arranged in opposite directions.

3. The hair claw clip according to claim 1, wherein a first hollow portion is arranged on said first body, and said first hollow portion is formed by a plurality of small holes.

4. The hair claw clip according to claim 1, wherein a second hollow portion is arranged on the second body, and said second hollow portion is formed by a plurality of small holes.

5. The hair claw clip according to claim 2, wherein a first hollow portion is arranged on said first body, and said first hollow portion is formed by a plurality of small holes.

6. The hair claw clip according to claim 2, wherein a second hollow portion is arranged on the second body, and said second hollow portion is formed by a plurality of small holes.

7. The hair claw clip according to claim 1, wherein said first body is provided with a first anti-slip member on an outer surface of the first body to increase the anti-slip effect of the hair claw clip, said second body is provided with a second anti-slip member on an outer surface of the second body to increase the anti-slip effect of the hair claw clip; said first anti-slip member and second anti-slip member is a plurality of lateral grooves.

8. The hair claw clip according to claim 2, wherein said first body is provided with a first anti-slip member on an outer surface of the first body to increase the anti-slip effect of the hair claw clip, said second body is provided with a second anti-slip member on an outer surface of the second body to increase the anti-slip effect of the hair claw clip; said first anti-slip member and second anti-slip member is a plurality of lateral grooves.

* * * * *